United States Patent [19]

Hamada et al.

[11] 4,061,801

[45] Dec. 6, 1977

[54] METHOD OF PRODUCING ALUMINUM OR ALUMINUM ALLOY COATED STEEL SHEETS WITH AID OF POWDER METHOD

[75] Inventors: Motoharu Hamada; Shunichi Harada, both of Chiba, Japan

[73] Assignee: Kawasaki Steel Corporation, Kobe, Japan

[21] Appl. No.: 701,105

[22] Filed: June 30, 1976

[30] Foreign Application Priority Data

July 19, 1975 Japan ..... 50-87857

[51] Int. Cl.[2] ..... C23C 9/00; C23B 5/50

[52] U.S. Cl. ..... 427/192; 427/383 D; 427/383 C; 427/406; 204/38 S; 428/548; 428/650; 428/653

[58] Field of Search ..... 427/383 C, 383 D, 192, 427/406; 204/38 S; 428/650, 653

[56] References Cited

U.S. PATENT DOCUMENTS

| | | | |
|---|---|---|---|
| 547,381 | 10/1895 | McKnight | 204/38 S |
| 1,565,496 | 12/1925 | Pfeil | 427/192 |
| 3,884,729 | 5/1975 | Jackson et al. | 204/38 S |

FOREIGN PATENT DOCUMENTS

| | | | |
|---|---|---|---|
| 2,141,663 | 3/1973 | Germany | 427/383 C |
| 350,469 | 6/1931 | United Kingdom | 204/38 S |

*Primary Examiner*—Ralph S. Kendall

[57] ABSTRACT

A method of producing an aluminum or aluminum alloy coated steel sheet with the aid of powder method is disclosed. The method comprises preliminarily applying a zinc coating having a thickness of 0.01 to 0.3 μm, preferably 0.03 to 0.3 μm to a steel sheet surface, applying an aluminum powder to the zinc coated steel sheet and subjecting the coated steel sheet to steps of heating, rolling and heating again or steps of rolling, heating, rolling again and heating again.

11 Claims, 1 Drawing Figure

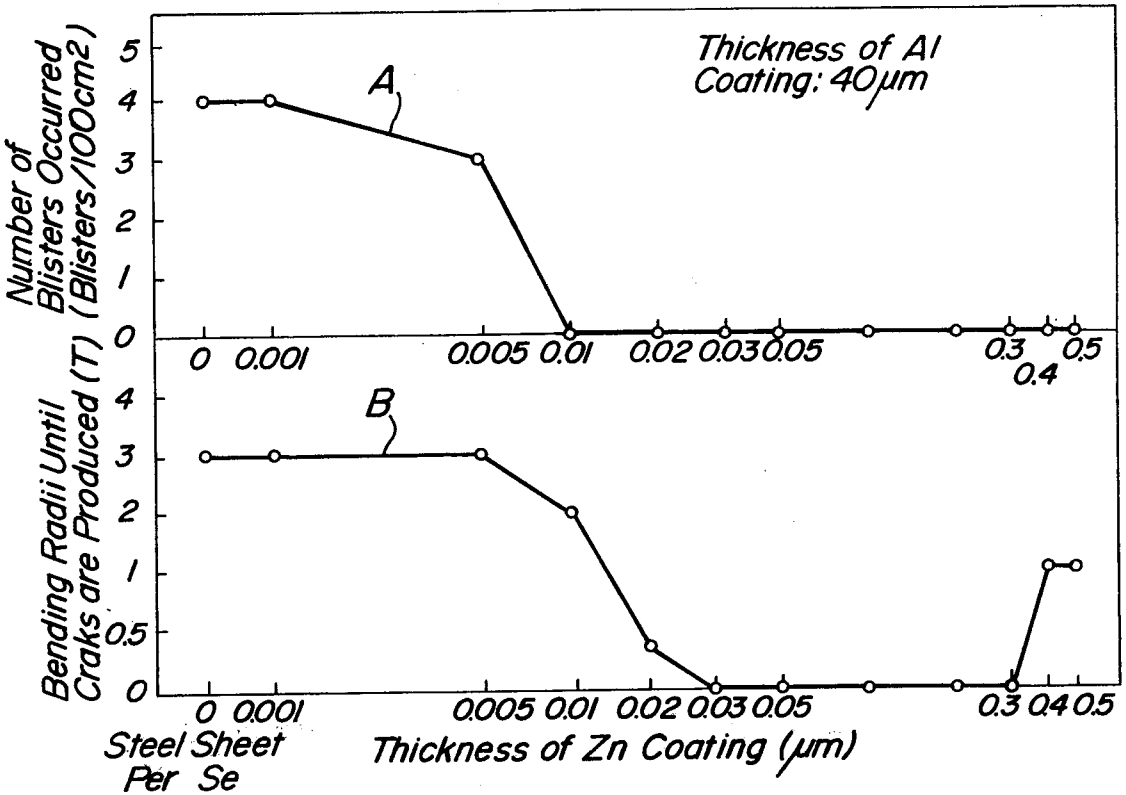
Thickness of Al Coating: 40μm
A
B
Number of Blisters Occurred (Blisters/100cm2)
Bending Radii Until Cracks are Produced (T)
Steel Sheet Per Se
Thickness of Zn Coating (μm)
0
0.001
0.005
0.01
0.02
0.03
0.05
0.3
0.4
0.5
1
2
3
4
5

METHOD OF PRODUCING ALUMINUM OR ALUMINUM ALLOY COATED STEEL SHEETS WITH AID OF POWDER METHOD

This invention relates to a method of producing aluminum or aluminum alloy coated steel sheets with the aid of powder method and are particularly to a method of producing an aluminum or aluminum alloy coated steel sheet with the aid of powder method, which can prevent ocurrence of blisters which are semisphere-shaped bents produced in the coated steel sheet surface and each having a diameter of at most 1 mm, and which can improve adherence of the aluminum coating.

The invention is based on such recognition that the following difficult problem which has been encountered with the prior art techniques of producing an aluminum or aluminum alloy coated steel sheet which comprise successive steps of applying to a steel sheet surface aluminum powder or a suspension containing aluminum powder dispersed therein, drying, heating, rolling and heating again the aluminum coated steel sheet (hereinafter will be called as one rolling method) or comprise successive steps of applying to a steel sheet surface aluminum powder or a suspension containing aluminum powder dispersed therein, rolling, heating, rolling again and heating again the aluminum coated steel sheet (hereinafter will be called as two rolling method) can effectively be eliminated by preliminarily applying to the steel sheet surface a coating of zinc.

In order to apply a steel sheet surface a coating of aluminum with the aid of powder method, the following three methods have been proposed, i.e., 1. a first method which comprises applying to a steel sheet surface a suspension composed of an aqueous solution added with an inhibitor and containing aluminum powder dispersed therein, and effecting the one or two rolling method;

2. a second method which comprises applying to a steel sheet surface a suspension composed of an alkaline aqueous solution containing both an inhibitor and aluminum powder dispersed therein, and effecting the one or two rolling method; and 3. a third method which comprises preliminarily electroplating iron to a steel sheet surface, applying aluminum powder to the iron-electroplated steel sheet, and effecting the one or two rolling method.

These conventional methods, however, have the following disadvantages.

In the first method, use is made of sodium nitrite and sodium molybdate as an inhibitor for the steel sheet and water added with malonic acid, etc. as an inhibitor for the aluminum powder. The inhibitor for the steel sheet such as sodium nitrite, etc. exhibits its effect as the inhibitor when it is in alkaline aqueous solution, while the inhibitor for the aluminum powder such as malonic acid exhibits its effect as the inhibitor when it is in acid aqueous solution.

In the first method, however, these alkaline and acid inhibitors are mixedly present at the same time in the same aqueous solution, so that their effect as the inhibitor becomes insufficient. As a result, a number of blisters are produced in and dotted over the steel surface. In addition, in an interphase between the steel sheet and the aluminum is grown a brittle iron-aluminum alloy layer which reduces formability of the coated steel sheet.

In the second method, in order to remove a surface oxide film on the aluminum as much as possible so as to expose the aluminum metal per se, use is made of an aqueous solution containing an inhibitor such as sodium silicate, etc. having a high ratio of silicic acid to sodium, for example, 2:1 and having a pH of 8 to 11.5. As a result, the aluminum powder is dissolved in the suspension to generate hydrogen bubbles. On the other hand, in the coating on the steel sheet, particularly when the coating is dried after application thereof, a water content becomes evaporated to increase the alkaline property of the coating. As a result, the resolving reaction of the aluminum becomes accelerated to increase corrosion product of aluminum and hence even when the two rolling method is used, in practice it is difficult to completely prevent occurrence of blisters after the final heating.

If the steel sheet directly coated with aluminum is subjected to a cold rolling with a rate of reduction in thickness of 50 to 90% and thereafter subjected to recrystallization annealing, it is necessary to effect the recrystallization annealing at a temperature of at least 500° C for the purpose of avoiding influence due to the cold rolling. In this case, even at 500° C, there is produced a brittle iron-aluminum alloy layer.

In the third method, in order to reduce the thickness of the iron-aluminum alloy layer, the steel sheet is preliminarily plated with iron so as to raise the temperature necessary for producing the nucleus of the iron-aluminum alloy layer. Even in this third method, the iron-aluminum alloy layer produced is too thick to obtain the formability of the steel sheet.

As seen from the above, all of the above mentioned conventional methods are difficult in preventing occurrence of the blisters and at the same time improving the adherence of the coating.

An object of the invention is to obviate the above mentioned disadvantages of the conventional methods and provide a method of producing an aluminum coated steel sheet, affording an aluminum coating having superior adherence and anti-blister property.

A feature of the invention is the provision of a method of producing an aluminum or aluminum alloy coated steel sheet with the aid of powder method, comprising preliminarily applying a zinc coating having a thickness of 0.01 to 0.3 μm to a steel sheet surface, applying an aluminum powder in laminated state to the zinc coated steel sheet, and subjecting to the coated steel sheet steps of heating, rolling and heating again or steps of rolling, heating, rolling again and heating again.

The thickness of the zinc coating preliminarily applied to the steel sheet is limited to 0.01 to 0.3 μm, preferably 0.03 to 0.3 μm.

The invention will now be described in greater detail with reference to the accompanying drawing, wherein:

The FIGURE shows two curves A and B that are used in explaining number of blisters occurred and bending radii until cracks are produced, both as related to the change in thickness of the zinc coating on a steel sheet to be described with reference to example 1, respectively.

As shown by a curve A in the drawing, the thickness of the zinc coating of at least 0.01 μm is sufficient to completely prevent occurrence of blisters. But, the thickness of the zinc coating is required to be at least 0.03 μm in order to improve the formability of the coated steel sheet as shown by a curve B in the drawing. Thus, the lower limit of the thickness of the zinc coating is determined 0.03 μm. However, if the thickness of the zinc coating exceeds 0.3 μm, the formability of the coated steel sheet becomes deteriorated again as shown by the curve B in the drawing. Thus, the upper limit of the thickness of the zinc coating is determined 0.3 μm. The above is the reasons why the thickness of the zinc coating is limited to 0.01 to 0.3 μm, preferably 0.03 to 0.3 μm.

In the drawing, the bending radii until cracks are produced on the coated steel surface are shown by 0T, 1T, 2T, 3T and 4T, respectively, where T is a thickness of the coated steel sheet and the evaluation 0T means that two legs formed by bending the coated steel sheet having a thickness T are closely contact with each other without producing any crack.

In accordance with the invention, the aluminum powder may be applied to the zinc coating in the form of powder per se or in the form of a suspension containing the aluminum powder dispersed therein.

As a method of applying the suspension to the steel sheet surface preliminarily coated with zinc, use may be made of barcoater method, roll coater method, spray method, etc. which have heretofore been used as painting methods.

As an absorption type inhibitor for aluminum contained in the suspension according to the invention, use may be made of one or two kinds of compounds selected from the group consisting of carboxy compound, an oxygen containing compound such as ketone and a nitrogen containing compound such as amine compound. The pH value of the suspension may be adjusted to 4 to 8. If the pH value of the suspension becomes smaller than 4, the hydrophobic property of the suspension becomes excessively large so that it is difficult to uniformly apply the suspension to the steel sheet surface. On the contrary, if the pH value of the suspension becomes larger than 8, its corrosion resistant effect becomes weak.

After application of the suspension and drying, either one rolling method or two rolling method may be effected. In the one rolling method, after application of the suspension, the coating is heated to such an extent that the coating becomes dried and thereafter the dried coating is heated at 400° to 550° C so as to deliverate a sufficient amount of evaporating ingredient or combined water. After heating, the coated steel sheet is subjected to a rolling step with a rate of reduction in thickness of at least 5%. Finally, the coated steel sheet is heated again at a temperature within a range of 500° to 600° C under such condition that thin iron-zinc-aluminum alloy layer is produced.

The invention will now be described with reference to the following examples.

EXAMPLE 1

A steel sheet having a thickness of 0.7 mm was degreased electrolytically by 50 g/l of caustic soda at 80° C and 6 A/dm$^2$, rinsed in water, pickled in hydrochloric acid at room temperature for 10 seconds, rinsed in water again and electrochemically plated with zinc by a plating bath containing 240 g/l of zinc sulfate, 15 g/l of ammonium chloride, 30 g/l of aluminum sulfate, 15 g/l of sodium acetate and 1 g/l of licorice and having a pH of 4.0 at 30° C and a current density of 3 A/dm$^2$.

To the steel sheet preliminarily plated with zinc was applied a suspension containing atomized aluminum powder dispersed therein by means of a barcoater. The suspension was composed of 10 g of an aqueous solution added with $10^{-5}$ mol/l of caprylic acid and having a pH of 4.6, and of 8 g of atomized aluminum powder having −320 meshes and dispersed therein. The steel sheet applied with the suspension was dried at 150° C for 10 minutes and thereafter heated at 450° C for 2 minutes in atmospheric air and passed to a rolling mill by which the thickness of the steel sheet was reduced by 7%. Finally, the steel sheet was heated again at 550° for 10 seconds. The thickness of the aluminum coating of the steel sheet was 46 μm.

Articles formed of the steel sheet treated according to the present example showed a beautiful metallic luster, no occurrence of blisters and excellent bendability until the articles were closely bent.

EXAMPLE 2

A steel sheet having a thickness of 0.7 mm was electroplated with a zinc coating having a thickness of 0.1 μm in the same manner as in the Example 1. To the steel sheet preliminarily plated with zinc was applied a suspension containing aluminum powder dispersed therein by means of a roll-coater. The suspension was composed of 10 g of an aqueous solution added with $10^{-5}$mole/l of succinic acid and having a pH of 4.4 and of 8 g of atomized aluminum powder having −320 meshes and dispersed therein. The steel sheet applied with the suspension was dried at 150° C for 10 minutes and rolled with a rate of reduction in thickness of 2% and thereafter heated again at 400° C for 2 minutes in atmospheric air and rolled again with a rate of reduction in thickness of 7%. Finally, the steel sheet was heated again at 550° C for 10 seconds in atmospheric air. The thickness of the aluminum coating on the steel sheet was 52 μm.

Articles produced according to the present example also showed no blisters and excellent bendability until the article were closely bent.

EXAMPLE 3

A steel sheet having a thickness of 0.7 mm was preliminarily electroplated with a zinc coating having a thickness of 0.2 μ in the same manner as in the Example 1. To the steel sheet preliminarily electroplated with zinc was applied a suspension composed of 10 g of distilled water and of 8 g of atomized aluminum powder dispersed therein, a particle size of the aluminum powder being −320 meshes. The suspension was applied to the zinc coated steel sheet immediately after preparation thereof. The steel sheet applied with the suspension was treated under the same manufacturing condition as in the Example 1. The thickness of the aluminum coating of the steel sheet thus treated was 20 μm.

Articles produced according to the present example also showed no blisters and excellent bendability until the articles were closely bent.

EXAMPLE 4

A steel sheet having a thickness of 0.7 mm was preliminarily electroplated with a zinc coating having a thickness of 0.05 μm in the same manner as in the Example 1. The zinc electroplated steel sheet was then rinsed with water and thereafter on the wet steel sheet was sprinkled with a dry aluminum powder having a particle size of −320 meshes and then was treated under the same conditions as in the Example 1. The thickness of the aluminum coating on the steel sheet thus treated was 32 μm.

Articles produced according to the present example also showed no blisters and no cracks until the articles were closely bent.

EXAMPLE 5

A steel sheet having a thickness of 0.6 mm was preliminarily electroplated with a zinc coating having a thickness of 0.03 μm. To the zinc electroplated steel sheet was applied a suspension composed of 10 g of distilled water and of 8 g of atomized aluminum powder having a particle size of −250 meshes and dispersed therein. The suspension was maintained at room temperature for 12 hours and then applied to the zinc electroplated steel sheet. The steel sheet applied with the suspension was dried at 300° C for 20 seconds with the aid of hot air and thereafter rolled with a rate of reduction in thickness of 2% and then heated at 450° C in atmospheric air, rolled again with a rate of reduction in thickness of 5% and heated again at 550° C in atmospheric air. The thickness of the aluminum coating of the steel sheet thus treated was 30 μm. Articles produced according to the present example showed no blisters and excellent bendability until the articles were closely bent.

What is claimed is:

1. A method of producing an aluminum or aluminum alloy coated steel sheet with the aid of powder method, comprising preliminarily electroplating a zinc coating having a thickness of 0.01 to 0.3 μm to a steel sheet surface, applying an aluminum powder to the zinc coated steel sheet, and subjecting to the coated steel sheet steps of heating, rolling and heating again.

2. A method according to claim 1 wherein the thickness of said zinc coating is limited to 0.03 to 0.3 μm.

3. A method according to claim 1 wherein said zinc coating is obtained by electroplating zinc to the steel sheet surface.

4. A method according to claim 1 wherein said aluminum powder is applied to the zinc coated steel sheet in a form of suspension containing said aluminum powder dispersed therein.

5. A method according to claim 1 wherein said aluminum powder is applied to the zinc coated steel sheet in a form of dry powder.

6. A method according to claim 1 wherein said aluminum powder has a particle size of −250 meshes.

7. A method according to claim 1 wherein said aluminum powder has a particle size of −320 meshes.

8. A method according to claim 4 wherein said suspension is composed of water and aluminum powder dispersed therein.

9. A method according to claim 8 wherein said water is added with an inhibitor selected from the group consisting of a carboxy compound, an oxygen containing compound and nitrogen containing compound and has a pH of 4 to 8.

10. A method according to claim 4 wherein said suspension is applied to the zinc coated steel sheet within 12 hours after said suspension is prepared.

11. A method according to claim 1, wherein said coated steel sheet is subjected to steps of rolling, heating, rolling again and heating again.

* * * * *